US011497319B1

(12) United States Patent
Alarcon et al.

(10) Patent No.: US 11,497,319 B1
(45) Date of Patent: Nov. 15, 2022

(54) SYSTEM USED TO FIT FITTED SHEETS OVER A MATTRESS

(71) Applicants: David Alarcon, Hollywood, FL (US); Daniel Marcial Gonzalez, Miami, FL (US)

(72) Inventors: David Alarcon, Hollywood, FL (US); Daniel Marcial Gonzalez, Miami, FL (US)

( * ) Notice: Subject to any disclaimer, the term of this patent is extended or adjusted under 35 U.S.C. 154(b) by 0 days.

(21) Appl. No.: 17/868,493

(22) Filed: Jul. 19, 2022

(51) Int. Cl.
*A47C 21/02* (2006.01)
*A47C 31/00* (2006.01)

(52) U.S. Cl.
CPC ..... *A47C 21/022* (2013.01); *A47C 31/008* (2013.01)

(58) Field of Classification Search
CPC ..... A47C 21/022; A47C 31/008; Y10T 24/23
See application file for complete search history.

(56) References Cited

U.S. PATENT DOCUMENTS 8,429,773 B2 * 4/2013 Herman ..... A47C 21/022 24/72.5
9,414,977 B2 * 8/2016 Ponsi ..... A61G 7/1023
9,492,022 B2 * 11/2016 Nekhala ..... A47G 9/0246
9,844,276 B1 * 12/2017 Phillips ..... A47C 21/022
10,405,671 B2 * 9/2019 Emile ..... A47C 21/028
10,881,216 B1 * 1/2021 Shultz ..... A47C 21/022
11,096,501 B2 * 8/2021 Kujawa ..... A47C 21/022
11,382,435 B2 * 7/2022 Maurer ..... A47C 21/022
2009/0172881 A1 * 7/2009 Peterson ..... A47C 21/022 5/497
2009/0241261 A1 * 10/2009 Sack ..... A47C 21/022 5/498
2012/0005867 A1 * 1/2012 Whaley ..... A47C 21/022 24/302
2019/0014913 A1 * 1/2019 Poletowski ..... A47C 21/022
2020/0260886 A1 * 8/2020 Chen ..... A47C 21/022

* cited by examiner

*Primary Examiner* — Robert Sandy
*Assistant Examiner* — Louis A Mercado
(74) *Attorney, Agent, or Firm* — Ruben Alcoba, Esq.

(57) ABSTRACT

A system used to fit fitted sheets over a mattress. The system allows a user of the system to keep the fitted sheets unwrinkled when the user decides to lie on the mattress that uses the system. The system comprises of a rectangular housing, a plurality of mounts, a plurality of gear motors a plurality of pulleys, a plurality of straps, a motor speed controller that is operatively connected to each gear motor, a connector that is fixedly attached to an end of each strap, and a fitted sheet that defines a plurality of receivers that are positioned concentrically around a central axis of the fitted sheet, the connector that is fixedly attached to the end of each strap attaches to each receiver of the plurality of receivers of the fitted sheet.

8 Claims, 5 Drawing Sheets

SYSTEM USED TO FIT FITTED SHEETS OVER A MATTRESS

TECHNICAL FIELD

The present invention pertains to a system used to fit fitted sheets over a mattress.

BACKGROUND

Keeping fitted sheets over a mattress is a problem that has not been solved. Many attempts have been made to solve the problem, there is none known to the inventor that will address the issue in the same manner as the present invention.

The present invention will provide a user of the system with a manner of adjusting the sheets using a remote control.

The present invention will allow the user to sleep on unwrinkled sheets every time the user chooses to lay on the sheets that cover the user's mattress.

The present invention addresses the need of having unwrinkled sheets on a user's mattress.

SUMMARY

The present invention is directed to a system used to fit fitted sheets over a mattress. The system will allow a user of the system to keep the fitted sheets unwrinkled when the user decides to lie on the mattress that uses the system.

The system comprises of a rectangular housing, a plurality of mounts and each mount is mounted on the rectangular housing, a plurality of gear motors and each gear motor is mounted on each mount of the plurality of mounts, each gear motor is operatively connected to a pulley that is housed within each mount, a plurality of straps and each strap is secured to the pulley of each mount and each strap extends outward from rectangular housing from a plurality of apertures that are defined on all lateral sides of the rectangular housing, a motor speed controller that is operatively connected to each gear motor, a connector that is fixedly attached to an end of each strap, and a fitted sheet that defines a plurality of receivers that are positioned concentrically around a central axis of the fitted sheet, the connector that is fixedly attached to the end of each strap attaches to each receiver of the plurality of receivers of the fitted sheet.

Preferred embodiments of the present invention comprise of a remote control that operatively connects to the motor speed controller.

An object of the present invention is to provide a system that will allow a user to sleep on unwrinkled sheets.

Another object of the present invention is to provide a system that will allow a user to fit the user's fitted sheets via a remote control.

DRAWINGS

These and other features, aspects, and advantages of the present invention will become better understood with regards to the following description, appended claims, and drawings where:

DESCRIPTION

Figure 1:
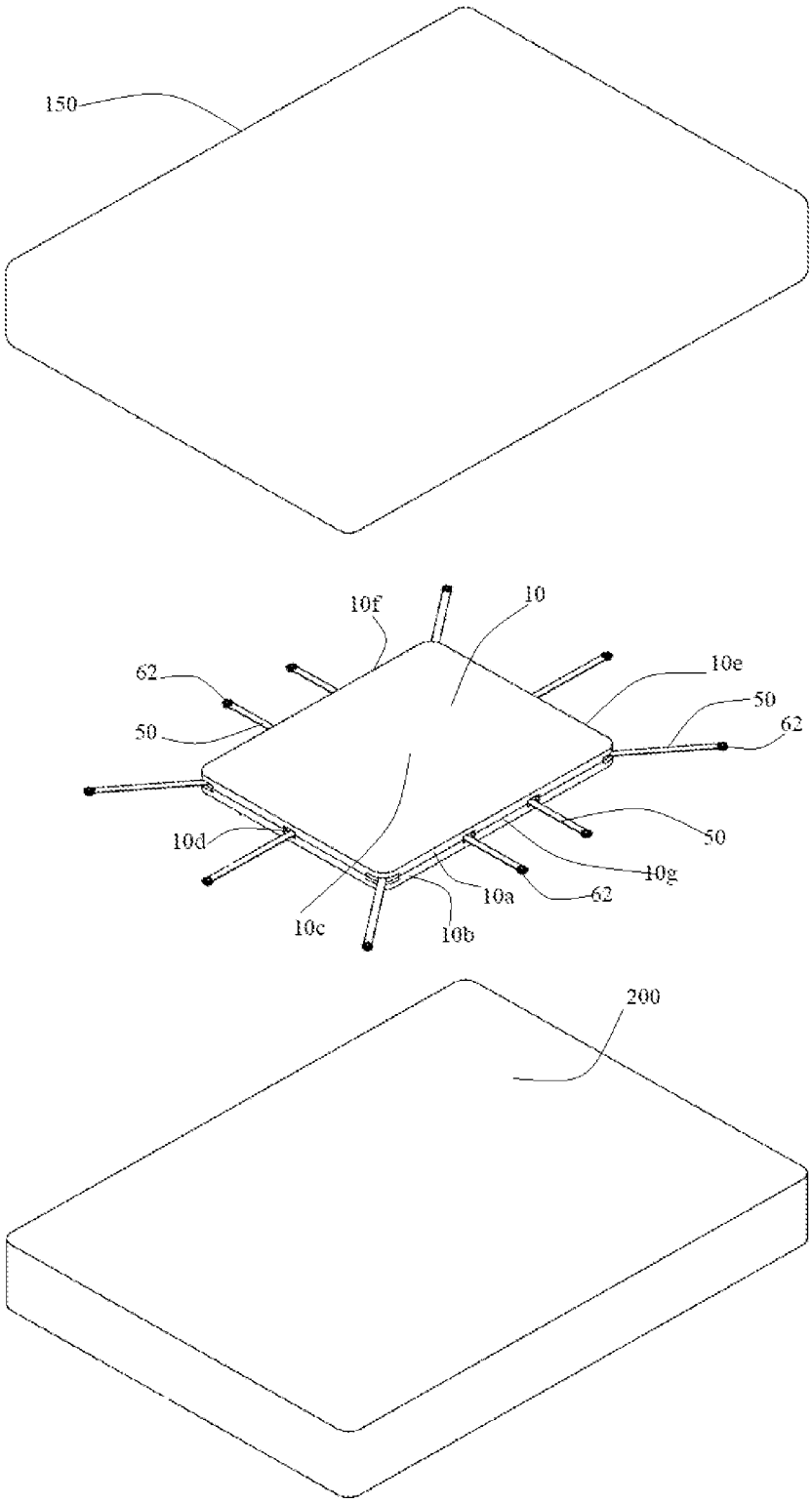
FIG. 1 is a perspective view of the system of the present invention that shows how the present invention is positioned between a bed frame and a mattress.
Figure 2:
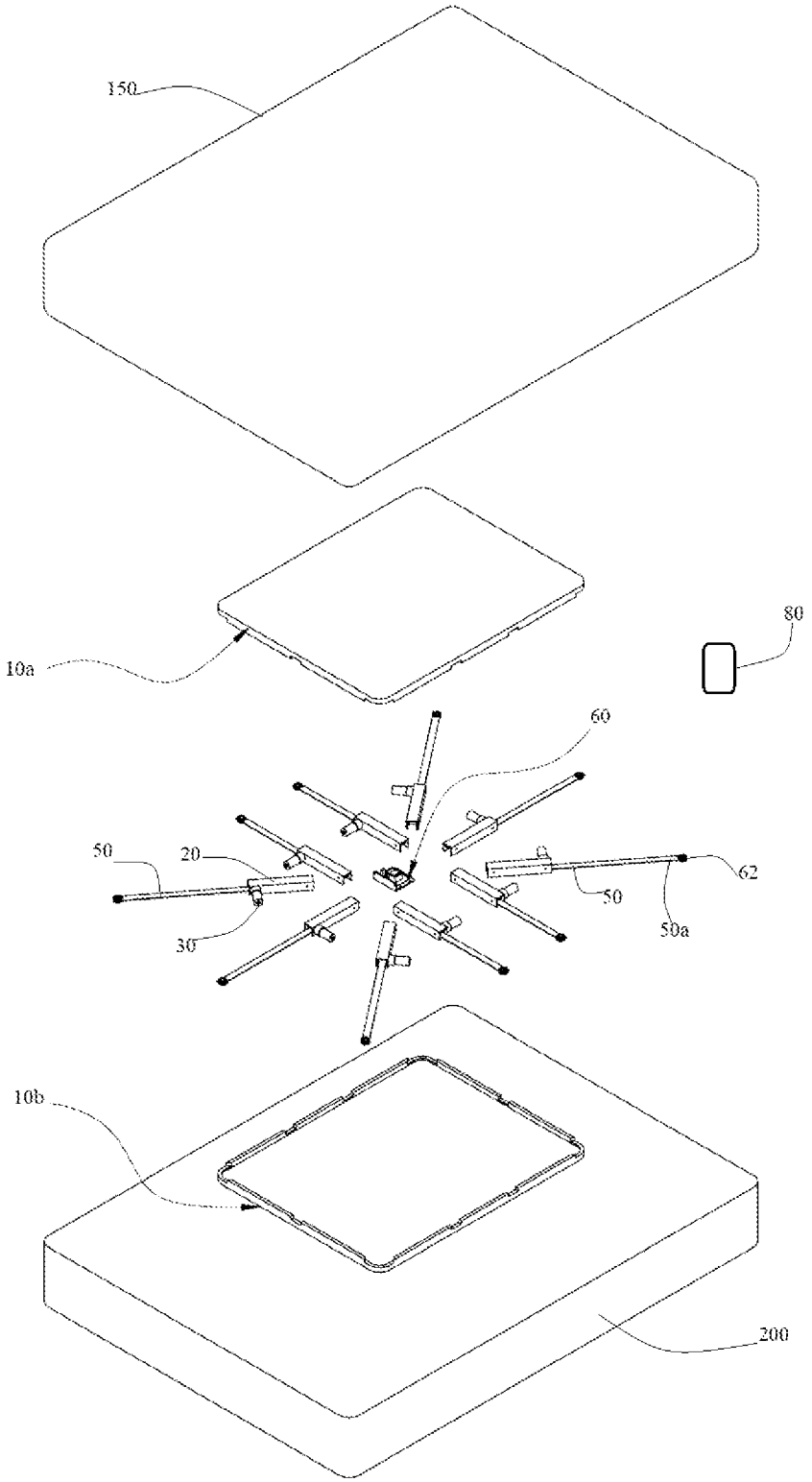
FIG. 2 is a perspective exploded view of the system of the present invention that shows how the present invention is positioned between a bed frame and a mattress.
Figure 3:
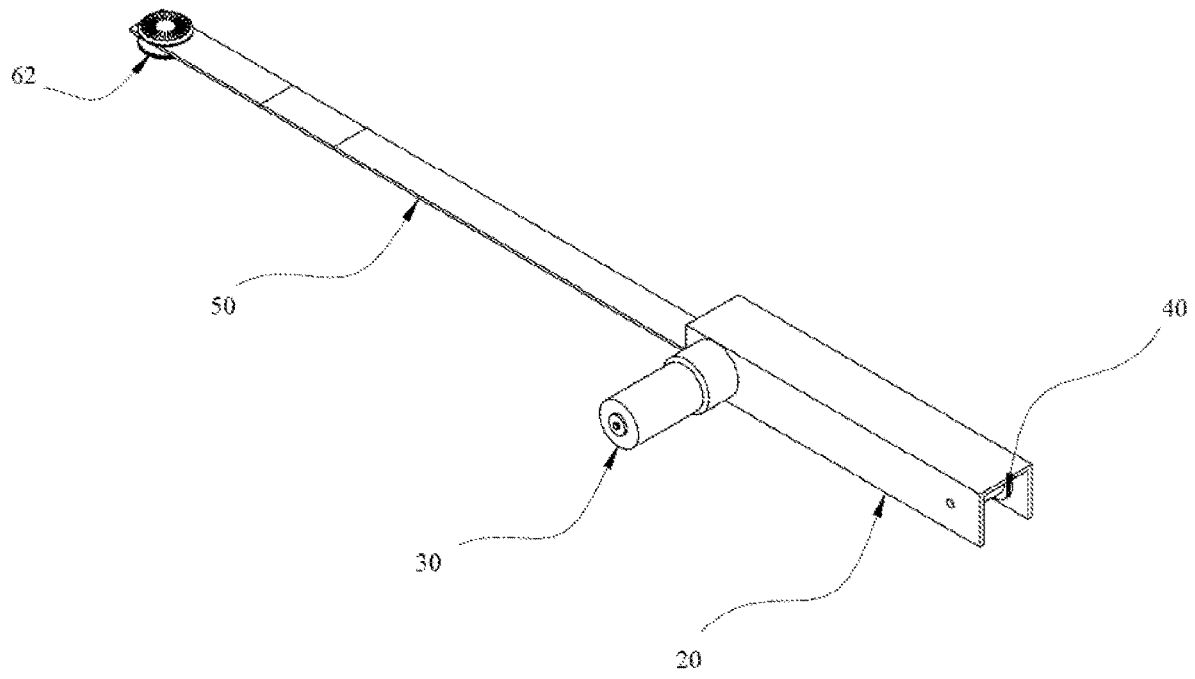
FIG. 3 is a perspective view of the mount, strap, gear motor, and pulleys of the present invention.
Figure 4:
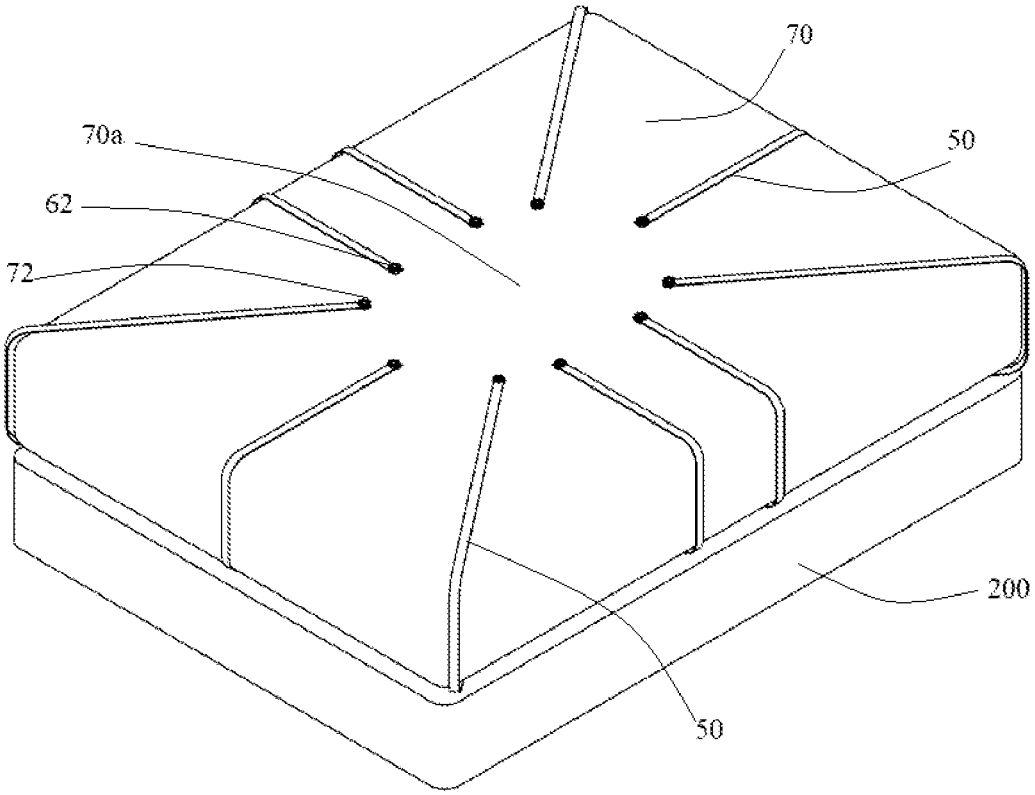
FIG. 4 is a perspective view of the system when it is secured to the fitted sheet.
Figure 5:
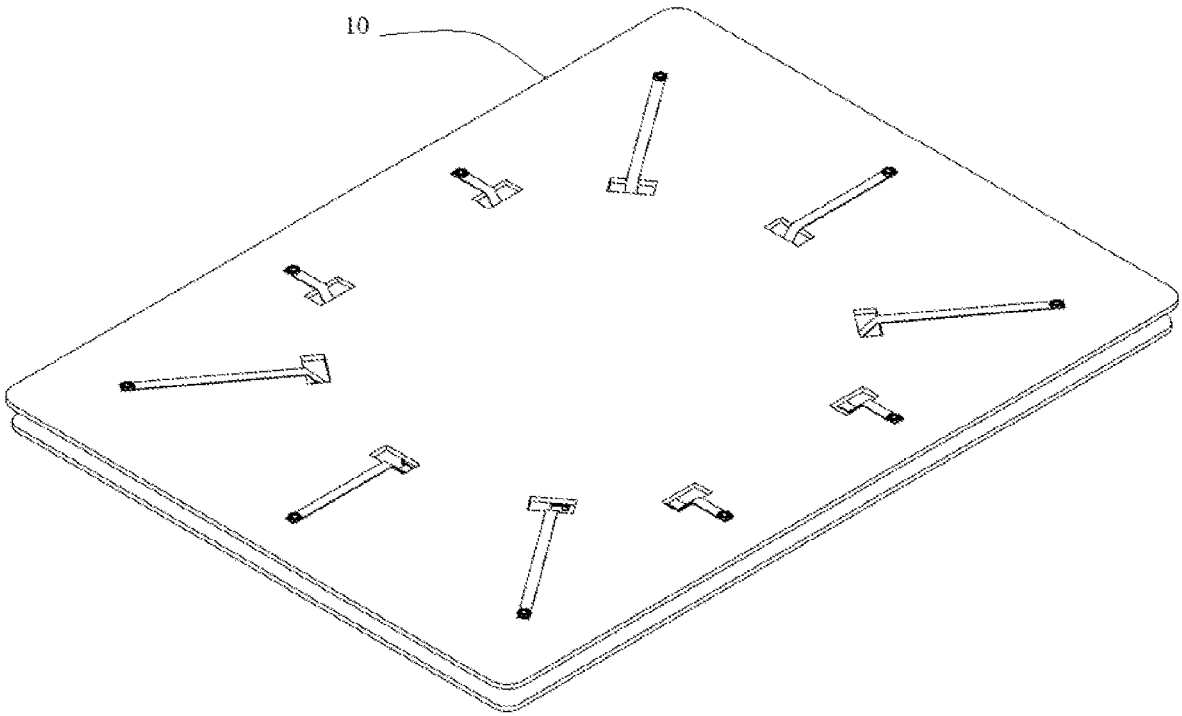
FIG. 5. Is a perspective view on a rectangular housing that can be used in one of the embodiments of the present invention.

Referring to FIGS. 1-5, the present invention is a system used to fit fitted sheets over a mattress.

The system used to fit fitted sheets over a mattress comprises a rectangular housing 10 having an upper 10*a* and a lower part 10*b*, the upper part 10*a* and the lower part 10*b* are connected. A plurality of mounts 20 are mounted on the lower part 10*b* of the rectangular housing 10 at positions that are concentric from a central axis 10*c* of the lower rectangular housing 10*a*. A plurality of gear motors 30, each gear motor 30 of the plurality of gear motors 30 is mounted on each mount 20 of the plurality of mounts 20, each gear motor 30 is operatively connected to a pulley 40 that is housed within each mount 20. A plurality of straps 50, each strap 50 is secured to the pulley 40 of each mount 20, each strap 50 extends outward from rectangular housing 10 from a plurality of apertures 10*d* that are defined on all lateral sides of the rectangular housing 10. A motor speed controller 60 that is operatively connected to each gear motor 30. A connector 62 that is fixedly attached to an end 50*a* of each strap 50. And, a fitted sheet 70 that defines a plurality of receivers 72 that are positioned concentrically around a central axis 70*a* of the fitted sheet 70, the connector 62 that is fixedly attached to the end 50*a* of each strap 50 attaches to each receiver 72 of the plurality of receivers 72 of the fitted sheet 70. The fitted sheet 70 is placed over a mattress 150.

Preferred embodiments of the present invention comprise of a remote control 80 that is operative connected to the motor speed controller 60. The remote control 80 connects to the motor speed controller 60 via a radio frequency.

In a preferred embodiment, each corner of the rectangular housing 10 defines a corner aperture 10*d* of the plurality of apertures 10*d*, wherein each of the rectangular housing's shorter sides 10*e* define a centrally positioned short side aperture 10*d*, and wherein each of the rectangular housing's longer sides 10*f* define at least two long side apertures 10*d*, each long side aperture 10*d* being an equal distance from a midpoint 10*g* of each of the rectangular housing's longer sides 10*f*.

In embodiments of the present invention, the rectangular housing 10 has the same dimensions as a bed frame in which the rectangular housing is placed upon.

In embodiments of the present invention, the strap 50 is a parametric strap.

In embodiments of the present invention, each connector 62 is a first polarity magnet and each receiver 72 is a second polarity magnet.

In other embodiments of the present invention, each connector 62 is a button and each receiver 72 is an eyelet that is sized to receive each button 62.

In still further embodiments, each connector 62 is clip and each receiver 72 is a clip attachment point.

An advantage of the present invention is that it provides a system that allows a user to sleep on unwrinkled sheets.

Another advantage of the present invention is that it provides a system that allows a user to fit the user's fitted sheets via a remote control.

The embodiments of the system used to fit fitted sheets over a mattress described herein are exemplary and numerous modifications, combinations, variations, and rearrangements can be readily envisioned to achieve an equivalent result, all of which are intended to be embraced within the scope of the appended claims. Further, nothing in the above-provided discussions of the system used to fit fitted sheets over a mattress should be construed as limiting the invention to an embodiment or a combination of embodiments. The scope of the invention is defined by the description, drawings, and appended claims.

What is claimed is:

1. A system used to fit fitted sheets over a mattress, the system comprises:

a rectangular housing having an upper part and a lower part, the upper part and the lower part are connected;

a plurality of mounts are mounted on the lower part of the rectangular housing at positions that are concentric from a central axis of the lower part of the rectangular housing;

a plurality of gear motors, each of the gear motor of the plurality of gear motors is mounted on each of the mount of the plurality of mounts, each of the gear motor is operatively connected to a pulley that is housed within each of the mount;

a plurality of straps, each of the strap is secured to the pulley of each of the mount, each of the strap extends outward from rectangular housing from a plurality of apertures that are defined on all lateral sides of the rectangular housing;

a motor speed controller that is operatively connected to each of the gear motor;

a connector that is fixedly attached to an end of each of the strap; and a fitted sheet that defines a plurality of receivers that are positioned concentrically around a central axis of the fitted sheet, the connector that is fixedly attached to the end of each of the strap attaches to each of the receiver of the plurality of receivers of the fitted sheet.

2. The system used to fit fitted sheets over the mattress of claim 1, the system comprises a remote controller that is operative connected to the motor speed controller.

3. The system used to fit fitted sheets over the mattress of claim 2, wherein each corner of the rectangular housing defines a corner aperture of the plurality of apertures, wherein each of a rectangular housing's shorter sides define a centrally positioned short side aperture, and wherein each of a rectangular housing's longer sides define at least two long side apertures, each of the long side aperture being an equal distance from a midpoint of each of the rectangular housing's longer sides.

4. The system used to fit fitted sheets over the mattress of claim 3, wherein the rectangular housing has same dimensions as a bed frame in which the rectangular housing is placed upon.

5. The system used to fit fitted sheets over the mattress of claim 4, wherein the strap is a parametric strap.

6. The system used to fit fitted sheets over the mattress of claim 5, wherein each of the connector is a first polarity magnet and each of the receiver is a second polarity magnet.

7. The system used to fit fitted sheets over the mattress of claim 5, wherein each of the connector is a button and each of the receiver is an eyelet that is sized to receive each button.

8. The system used to fit fitted sheets over the mattress of claim 5, wherein each of the connector is a clip and each of the receiver is a clip attachment point.

* * * * *